US007358840B1

(12) United States Patent
Shea et al.

(10) Patent No.: US 7,358,840 B1
(45) Date of Patent: Apr. 15, 2008

(54) ELECTRICAL SWITCHING APPARATUS INCLUDING A SPLIT CORE SLOT MOTOR AND METHOD OF INSTALLING A SLOT MOTOR ASSEMBLY IN A CIRCUIT INTERRUPTER

(75) Inventors: John J. Shea, Pittsburgh, PA (US); Jeffrey A. Miller, McKees Rocks, PA (US); Richard P. Malingowski, Finleyville, PA (US); William E. Beatty, Jr., Brighton Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/536,079

(22) Filed: Sep. 28, 2006

(51) Int. Cl.
*H01H 9/30* (2006.01)

(52) U.S. Cl. ..... 335/201

(58) Field of Classification Search ..... 335/201, 335/6, 16, 147

See application file for complete search history.

(56) References Cited

U.S. PATENT DOCUMENTS 4,375,021 A 2/1983 Pardini et al.
4,546,336 A 10/1985 Petrie et al.
4,546,337 A 10/1985 Petrie et al.
4,549,153 A 10/1985 Forsell et al.
4,970,482 A 11/1990 Jacobs et al.
5,694,098 A 12/1997 Mody et al.
6,281,459 B1 8/2001 Munsch et al.

*Primary Examiner*—Ramon M. Barrera
(74) *Attorney, Agent, or Firm*—Martin J. Moran

(57) ABSTRACT

A circuit breaker includes a housing, separable contacts, an operating mechanism structured to open and close the separable contacts, a power conductor comprising a first conductor and a second reverse loop conductor, the second reverse loop conductor carrying one of the separable contacts; and a split core slot motor. The split core slot motor comprises a first slot motor portion having a number of coupling points, and a second slot motor portion having a number of corresponding coupling points. The coupling points of the first slot motor portion engage the corresponding coupling points of the second slot motor portion to form the split core slot motor. Both of the slot motor portions cooperate to form a base of the split core slot motor. The base is disposed between the first conductor and the second reverse loop conductor.

8 Claims, 10 Drawing Sheets

ELECTRICAL SWITCHING APPARATUS INCLUDING A SPLIT CORE SLOT MOTOR AND METHOD OF INSTALLING A SLOT MOTOR ASSEMBLY IN A CIRCUIT INTERRUPTER

BACKGROUND OF THE INVENTION

1. Field of the Invention

The invention relates to electrical switching apparatus, such as, for example, circuit breakers and, more particularly, to circuit breakers employing a slot motor. The invention also relates to methods of installing slot motor assemblies in circuit interrupters.

2. Background Information

Circuit interrupters, such as circuit breakers, are employed in diverse capacities in power distribution systems. A circuit breaker may include, for example, a line conductor, a load conductor, a fixed contact and a movable contact, with the movable contact being movable into and out of electrically conductive engagement with the fixed contact. This switches the circuit breaker between an on or closed position and an off or open position, or between the on or closed position and a tripped or tripped off position. The fixed contact is electrically conductively engaged with one of the line and load conductors, and the movable contact is electrically conductively engaged with the other of the line and load conductors. The circuit breaker may also include an operating mechanism having a movable contact arm upon which the movable contact is disposed.

In order to enhance the speed of separation of the separable contacts, the contacts may be disposed within a slot motor, which increases interruption performance. Ring-shaped or loop-shaped slot motors typically have two assemblies, an upper assembly and a lower assembly. Both of the upper and lower assemblies include a corresponding insulative housing and a plurality of plates composed of magnetically permeable material (e.g., steel), which surrounds the separable contacts and the movable contact arm of the circuit breaker. The lower assembly is disposed below the fixed contact. When the power circuit is live, an electrical arc may be drawn between the separable contacts during separation. The electrical current interacts electromagnetically with the slot motor to induce a magnetic field in the magnetic material of the slot motor, which, in turns, interacts with the separating contacts and the movable contact arm to accelerate the contact opening process. Examples of slot motors are disclosed in U.S. Pat. Nos. 4,375,021; 4,546,336; 4,546,337; 4,549,153; 4,970,482; 5,694,098, and 6,281,459.

As shown in FIG. 1, the upper assembly is an inverted U-shaped assembly having a housing assembly 1 and a plurality of plates 2, forming a bight portion 3 and two legs 4,5. The upper slot motor assembly is structured to be disposed over the movable contact (not shown) wherein the tips of the upper assembly legs 4,5 contact the lower slot motor assembly (not shown). The upper assembly legs 4,5 have an extended length to accommodate the path of travel of the movable contact arm (not shown). That is, the movable contact (not shown) is disposed between the upper assembly legs 4,5 and as the movable contact moves between the first, open position and the second, closed position, the movable contact moves from a position adjacent to the upper assembly bight portion 3 to a position adjacent the tips of the legs 4,5. Accordingly, the legs 4,5 have a sufficient length to accommodate the path of travel of the movable contact arm.

FIG. 2 shows a circuit breaker 6 including a housing 7, separable contacts 8,9 enclosed by the housing 7, and a spring powered operating mechanism 10 which opens the separable contacts 8,9 to interrupt the current through the conductors of an electrical system (not shown) in response to electrical fault conditions. The circuit breaker 6 also includes a loop-shaped slot motor 12 and an arc chute 14. The separable contacts 8,9 generally comprise one or more movable contacts 8 and one or more corresponding stationary contacts 9. Each movable contact 8 is disposed at or about a first end 16 of a spring-biased movable contact arm 18. The spring-biased movable contact arm 18 is pivotably coupled, at or about its second end 20, to a crossbar 22 of the operating mechanism 10. The crossbar 22 carries the movable contact arms 18 for all of the poles 24 (only one pole 24 is shown) of the circuit breaker 6, and cooperates with a cradle 26 of the circuit breaker operating mechanism 10 to allow for simultaneous opening and closing of the contacts 8,9 in all of the poles 24.

The operating mechanism 10 controls the spring-biased movable contact arm 18 to pivot the movable contact 8 into and out of electrical contact with the corresponding stationary contact 9. A contact arm spring 28 biases the second end 20 of the movable contact arm 18, proximate the operating mechanism crossbar 22, in order to maintain the closed position (shown in phantom line drawing) of the pair of movable and stationary contacts 8,9.

A slot motor having a relatively narrow width channel is essential for effective current-limiting and arc quenching. However, assembly of a narrow width channel slot motor becomes a manufacturing challenge since the narrow width channel and the shape of the reverse loop conductor prevent assembly. For example, in one prior proposal, such as the circuit breaker 6 of FIG. 2, a copper reverse loop conductor 30 is bent upward (not shown) to allow the slot motor 12 to slide around the conductor 30. Then, the copper conductor 30 is re-bent back to its intended position (as shown in FIG. 2). The bending stresses the copper conductor 30, which, generally, cannot be reliably re-bent back to the proper position especially with the slot motor 12 in place.

There is room for improvement in electrical switching apparatus, such as circuit breakers, employing a slot motor.

There is also room for improvement in methods of installing slot motor assemblies in circuit interrupters.

SUMMARY OF THE INVENTION

These needs and others are met by the embodiments of the invention, which provide, for example, a split core slot motor or a U-shaped slot motor assembly that do not require that the reverse loop conductor be deformed.

In accordance with one aspect of the invention, an electrical switching apparatus comprises: a housing; separable contacts; an operating mechanism structured to open and close the separable contacts; a power conductor comprising a first conductor and a second reverse loop conductor, the second reverse loop conductor carrying one of the separable contacts; and a split core slot motor comprising: a first slot motor portion having a number of coupling points, and a second slot motor portion having a number of corresponding coupling points, wherein the coupling points of the first slot motor portion engage the corresponding coupling points of the second slot motor portion to form the split core slot motor, wherein both of the first and second slot motor portions cooperate to form a base of the split core slot motor, and wherein the base of the split core slot motor is disposed between the first conductor and the second reverse loop conductor.

The number of coupling points may be one coupling point and the number of corresponding coupling points may be one corresponding coupling point; and the one coupling point and the one corresponding coupling point may be coupled between the first conductor and the second reverse loop conductor.

The number of coupling points may be two coupling points and the number of corresponding coupling points may be two corresponding coupling points; and the two coupling points and the two corresponding coupling points may be coupled between the first conductor and the second reverse loop conductor.

The coupling points of the first slot motor portion may engage the corresponding coupling points of the second slot motor portion to form the split core slot motor without deforming the reverse loop conductor.

Each of the first slot motor portion and the second slot motor portion may comprise an insulative cover made of an out-gassing material.

The power conductor may further comprise an intermediate conductor having an arcuate profile intermediate the first conductor and the second reverse loop conductor; and the insulative cover may be molded to form fit the arcuate profile of the intermediate conductor.

As another aspect of the invention, an electrical switching apparatus comprises: a housing; separable contacts; an arc chute proximate the separable contacts; an operating mechanism structured to open and close the separable contacts; a power conductor comprising a first conductor and a second reverse loop conductor, the second reverse loop conductor carrying one of the separable contacts; and a split core slot motor comprising: a first slot motor portion having a number of coupling points, and a second slot motor portion having a number of corresponding coupling points, wherein the coupling points of the first slot motor portion engage the corresponding coupling points of the second slot motor portion to form the split core slot motor, wherein both of the first and second slot motor portions cooperate to form a base of the split core slot motor, and wherein the base of the split core slot motor is disposed between the first conductor and the second reverse loop conductor.

The split core slot motor may have a generally U-shape.

As another aspect of the invention, a method of installing a slot motor assembly in a circuit interrupter comprises: employing a generally U-shaped slot motor assembly having two legs and a base; employing a circuit breaker power conductor including a first conductor and a second reverse loop conductor; passing one of the legs of the generally U-shaped slot motor assembly between the first conductor and the second reverse loop conductor; positioning the base of the generally U-shaped slot motor assembly proximate the second reverse loop conductor; and rotating the generally U-shaped slot motor assembly until the base is between the first conductor and the second reverse loop conductor.

The method may further comprise disposing the one of the legs of the generally U-shaped slot motor assembly generally planar with respect to the first conductor and the second reverse loop conductor before rotating the generally U-shaped slot motor assembly about 90° until the legs of the generally U-shaped slot motor assembly are generally normal with respect to the first conductor and the second reverse loop conductor.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
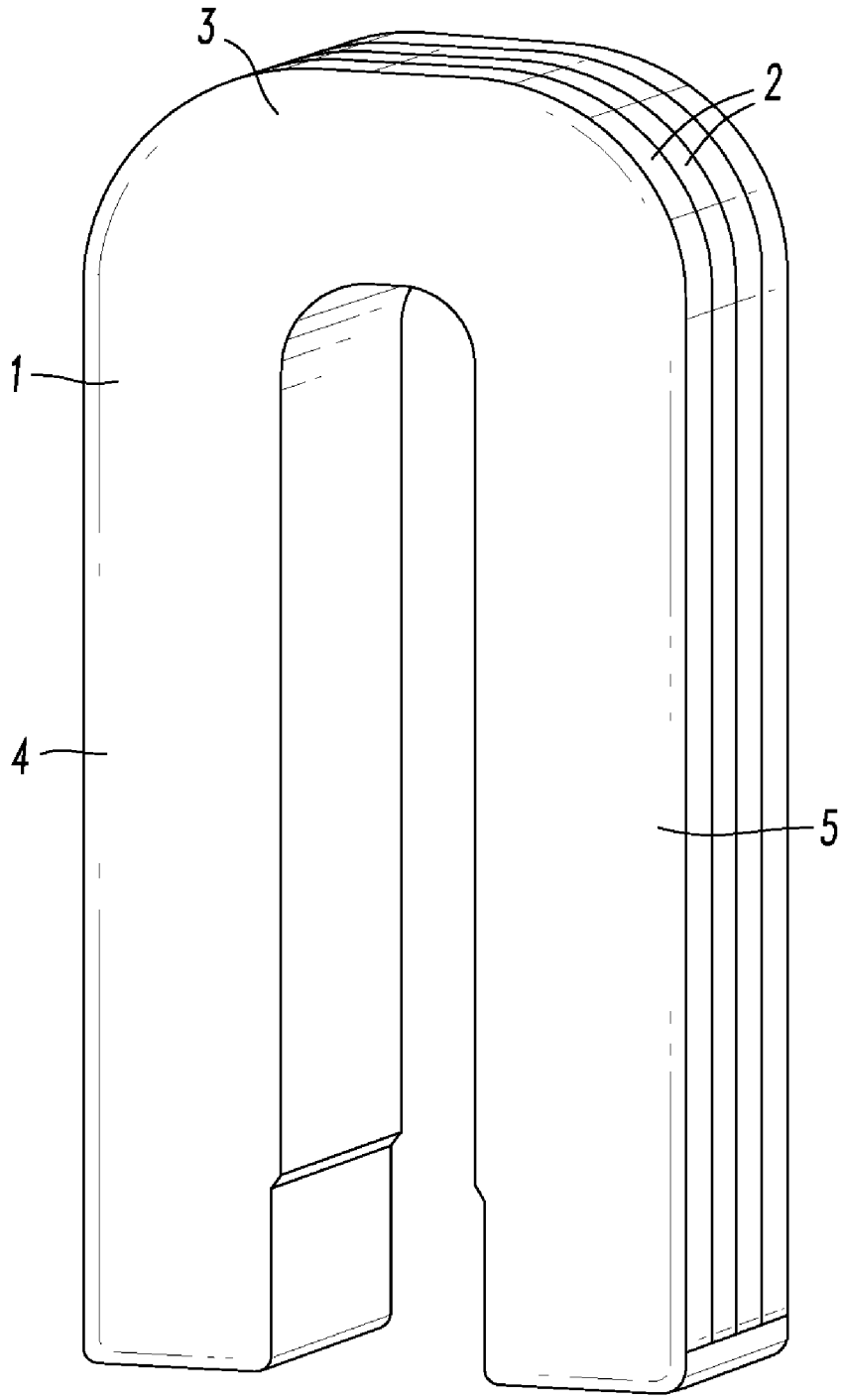
FIG. 1 PRIOR ART
FIG. 1 is an isometric view of an upper slot motor assembly.
Figure 2:
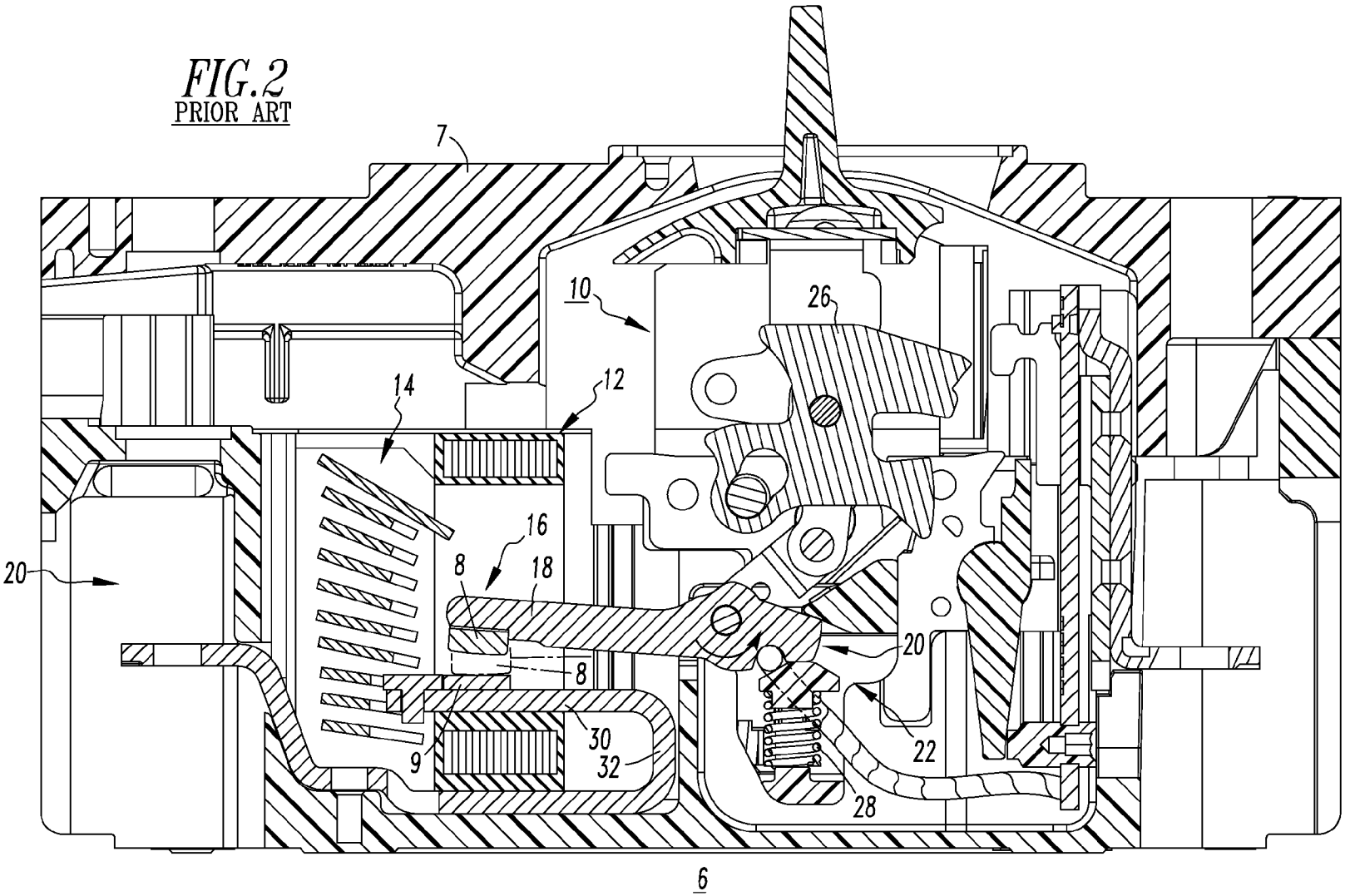
FIG.2 PRIOR ART
FIG. 2 is a vertical elevation view of a circuit breaker including a loop-shaped slot motor.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the terms "generally U-shaped" or "generally U-shape" shall mean that the shape of a corresponding structure has the general shape of the letter "U," in which the bottom of such letter or structure is rounded, generally round, square, generally square, or partially round and partially square, or has the general shape of a base member with two leg (or arm) members extending upward from the ends of the base member.

The invention is described in association with a circuit breaker having a single pole, although the invention is applicable to a wide range of electrical switching apparatus having any suitable number of poles (e.g., two; three; or more).

Referring to FIGS. 3A-3D and 5, a circuit breaker 100 (FIG. 5) includes a housing 102 (best shown in phantom line drawing in FIG. 3D), separable contacts 104,106, an operating mechanism 108 structured to open and close the separable contacts 104,106, a power conductor 110 (e.g., a "reverse loop") including a first conductor 112 and a second reverse loop conductor 114, and a split core slot motor 115. The second reverse loop conductor 114 carries the stationary contact 106. In accordance with an important aspect of the invention, the split core slot motor 115 includes a first slot motor portion 116 (FIGS. 3A-3D) having a number of coupling points 118 (FIGS. 3A, 3C, 3D), and a second slot motor portion 120 (FIGS. 3A, 3C, 3D) having a number of corresponding coupling points 122 (shown in hidden line drawing in FIGS. 3C and 3D). The coupling points 118 of the first slot motor portion 116 engage the corresponding coupling points 122 of the second slot motor portion 120 to form the split core slot motor 115. The split core slot motor 115 has a base 124 (e.g., without limitation, bight portion) that is disposed between the first conductor 112 and the second reverse loop conductor 114. The base 124 is formed by both of the first and second slot motor portions 116,120.

EXAMPLE 1

The example split core slot motor 115 of FIGS. 3A-3D has one coupling point that is formed by the engagement of the example single coupling point 118 of the first slot motor portion 116 with the example corresponding single coupling point 122 of the second slot motor portion 120. The split core slot motor 115 is formed from two insulative cover portions 126,128 and a plurality of steel laminations 130. Preferably, the external surface of the laminations 130 is covered by a suitable insulative tape 132. Although the insulative tape 132 is shown, any suitable insulator (e.g., without limitation, Limitrak™ epoxy paint) may be employed. As another alternative, the first and second slot motor portions 116,120 and the insulative cover portions 126,128 hold any suitable slot motor element, which in the example embodiment is the steel laminations 130, although a solid or other suitable slot motor element may be employed.

The insulative cover portions 126,128 include a surface 133 (FIG. 3D) proximate the stationary contact 106.

EXAMPLE 2

Alternatively, the laminations 130 may be held in place by the internal side walls 134,136 (FIG. 3D) of the circuit breaker 100. Here, the first and second slot motor portions 116,120 are coupled together about the power conductor 110, which is then assembled into the circuit breaker 100. In that example, in addition to the one coupling point formed by the engagement of the example single coupling points 118,122, the side walls 134,136 preferably hold the slot motor 115 together.

EXAMPLE 3

The coupling point 118 is a post and the corresponding coupling point 122 is a recess. The coupling point post 118 engages the second slot motor portion 120 at the coupling point recess 122 thereof to form the split core slot motor 115.

EXAMPLE 4

The coupling point 118 of the first slot motor portion 116 engages the corresponding coupling point 122 of the second slot motor portion 120 to form the split core slot motor 115 without deforming the reverse loop conductor 114. In other words, the first slot motor portion 116 engages the corresponding second slot motor portion 120 without the need to move and, thus, deform (e.g., by otherwise bending it away from the first conductor 112) the reverse loop conductor 114.

EXAMPLE 5

The example split core slot motor 115' of FIGS. 4A-4D has two coupling points that are formed by the engagement of the example two coupling points 118' (e.g., without limitation, posts) (as best shown in hidden line drawing in FIG. 4C) of the first slot motor portion 116' with the example corresponding two coupling points 122' (e.g., without limitation, recesses) (as best shown in hidden line drawing in FIG. 4C) of the second slot motor portion 120'. The coupling points 118',122' are coupled between the first conductor 112' and the second reverse loop conductor 114'. The split core slot motor 115' is formed from two insulative cover portions 126',128' and a plurality of steel laminations 130'. Preferably, the external surface of the laminations 130' is covered by a suitable insulative tape 132. Although the insulative tape 132 is shown, any suitable insulator (e.g., without limitation, Limitrak™ epoxy paint) may be employed.

EXAMPLE 6

Figure 4A:
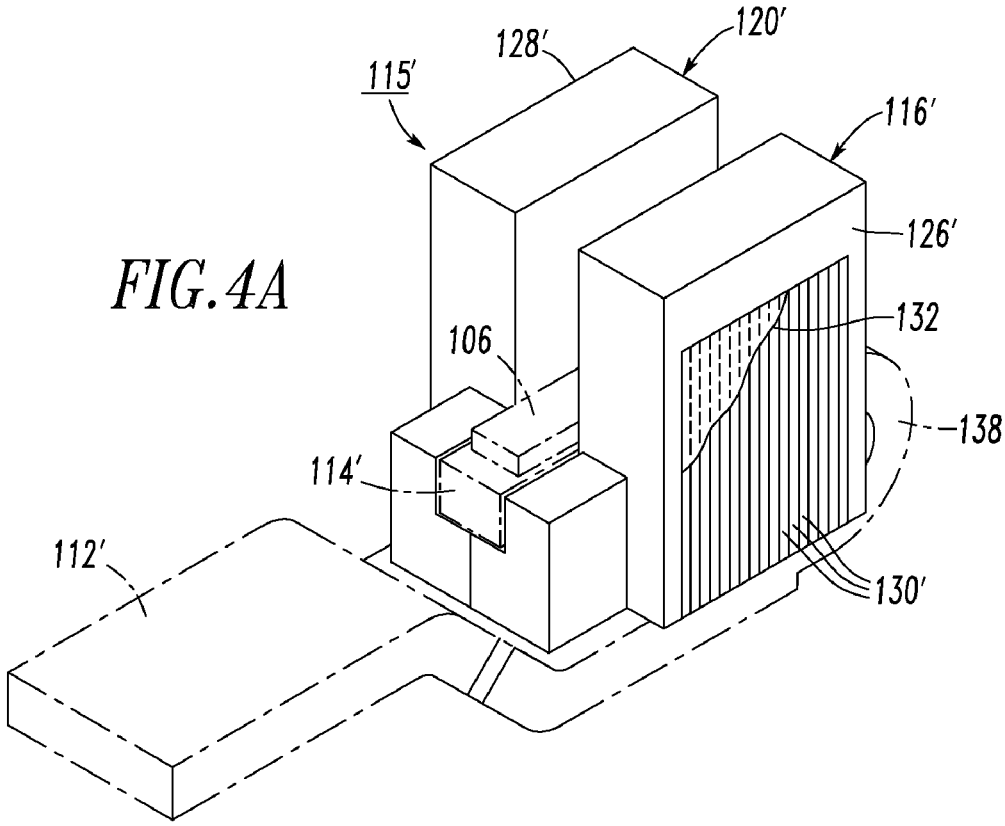
FIG. 4A is an isometric view of a split core slot motor having two coupling points in accordance with another embodiment of the invention.
Figure 4B:
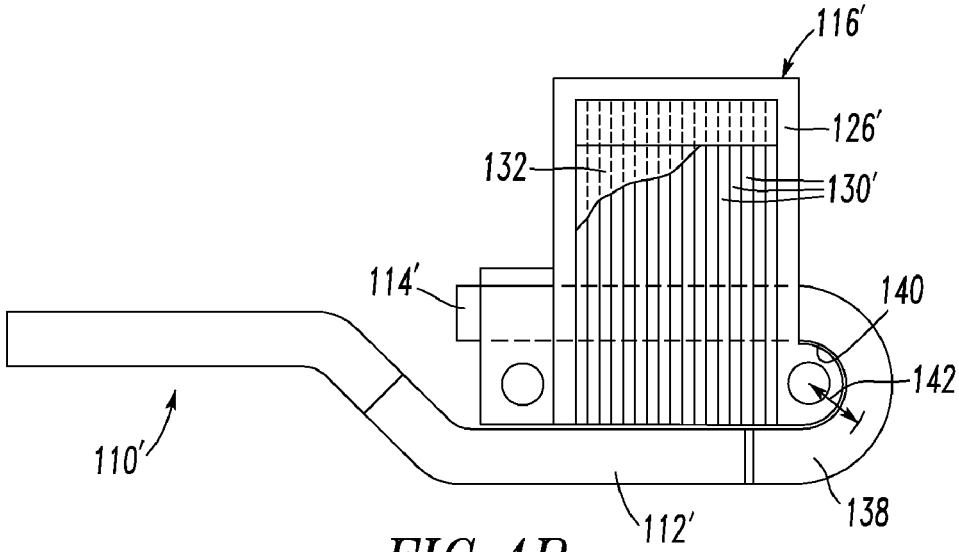
FIGS. 4B, 4C and 4D are vertical elevation, plan and end elevation views, respectively, of the split core slot motor of FIG. 4A engaging a reverse loop conductor.
Figure 4C:
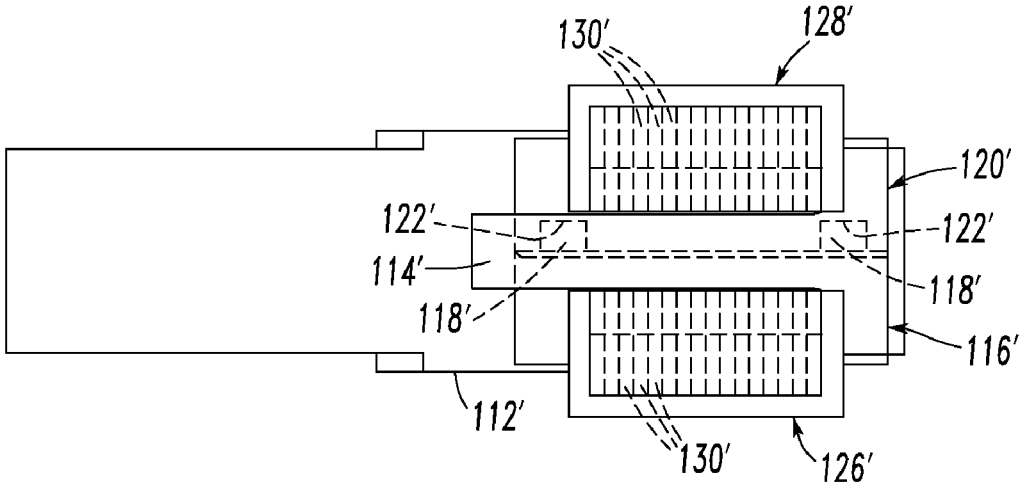
Figure 4D:
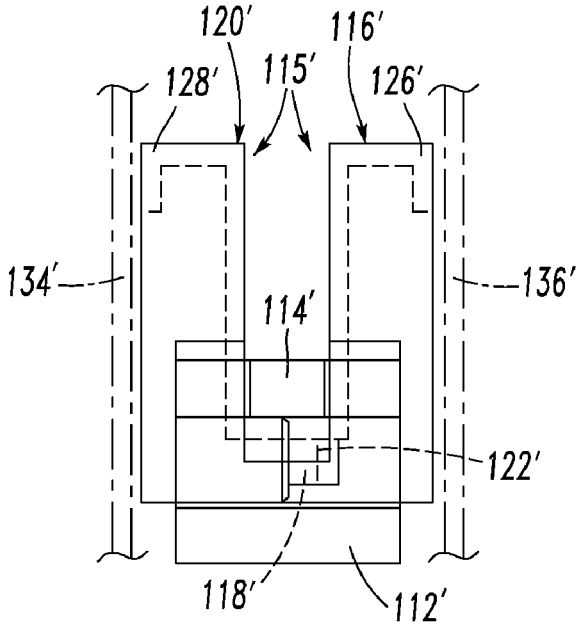

Alternatively, the laminations 130' may be held in place by the internal circuit breaker side walls 134',136' (FIG. 4D). In that example, in addition to the two coupling points formed by the engagement of the example two coupling points 118',122', the side walls 134',136' preferably hold the slot motor 115' together.

EXAMPLE 7

The power conductor 110' includes intermediate conductor 138 having an arcuate profile 140 intermediate the first conductor 112' and the second reverse loop conductor 114'. The shapes of the insulative cover portions 126',128' are preferably molded (as best shown in FIG. 4B with insulative cover portion 126'), to form fit around the arcuate profile 140 of the intermediate conductor 138. In this example, the steel volume of the laminations 130' is somewhat less than the steel volume of the laminations 130 of the split core slot motor 115 of FIG. 3A due to the laminations 130' being set back away from the bend radius 142 of the intermediate conductor 138 that leads to the second reverse loop conductor 114'. This provides room for the coupling point 118'.

EXAMPLE 8

The coupling points 118' of the first slot motor portion 116' engage the corresponding coupling points 122' of the second slot motor portion 120' to form the split core slot motor 115' without deforming the reverse loop conductor 114'. In other words, the first slot motor portion 116' engages the corresponding second slot motor portion 120' without the need to move and, thus, deform (e.g., by otherwise bending it away from the first conductor 112') the reverse loop conductor 114'.

EXAMPLE 9

Figure 3A:
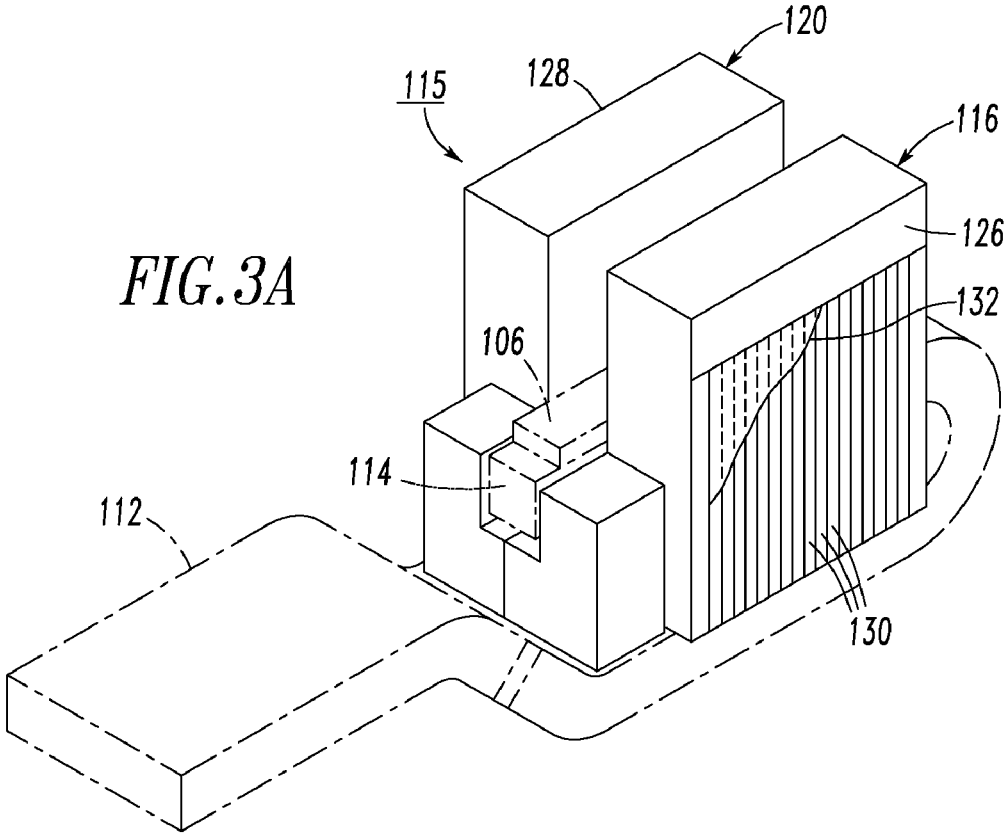
FIG. 3A is an isometric view of a split core slot motor having one coupling point in accordance with an embodiment of the invention.
Figure 3B:
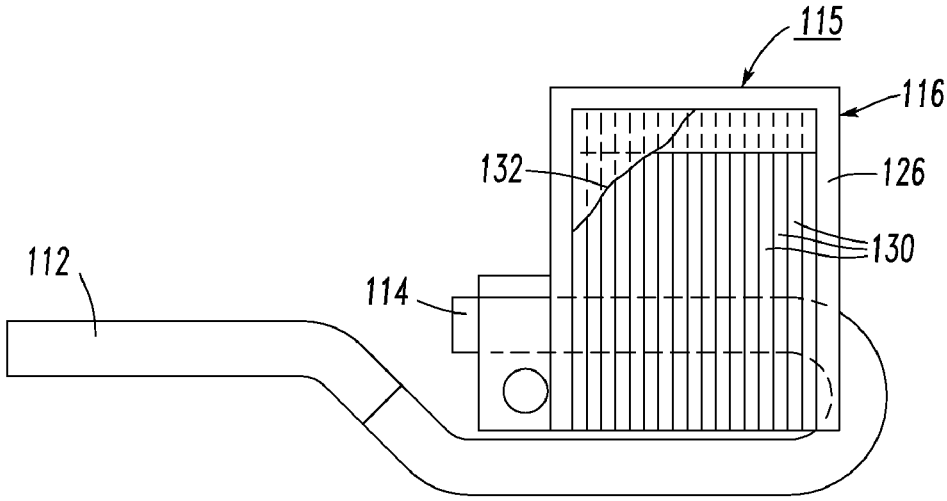
FIGS. 3B, 3C and 3D are vertical elevation, partially exploded plan and partially exploded end elevation views, respectively, of the split core slot motor of FIG. 3A engaging a reverse loop conductor.
Figure 3C:
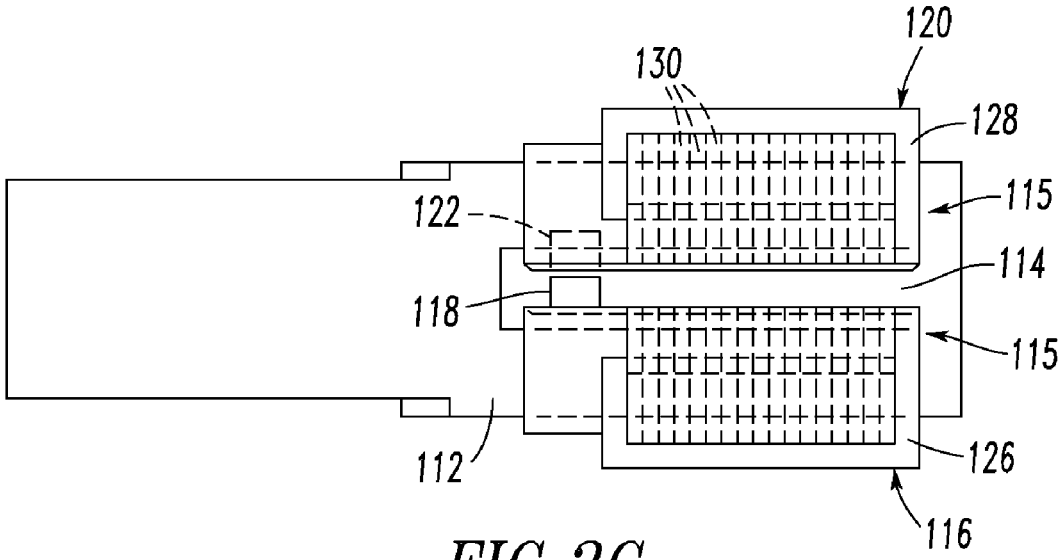
Figure 3D:
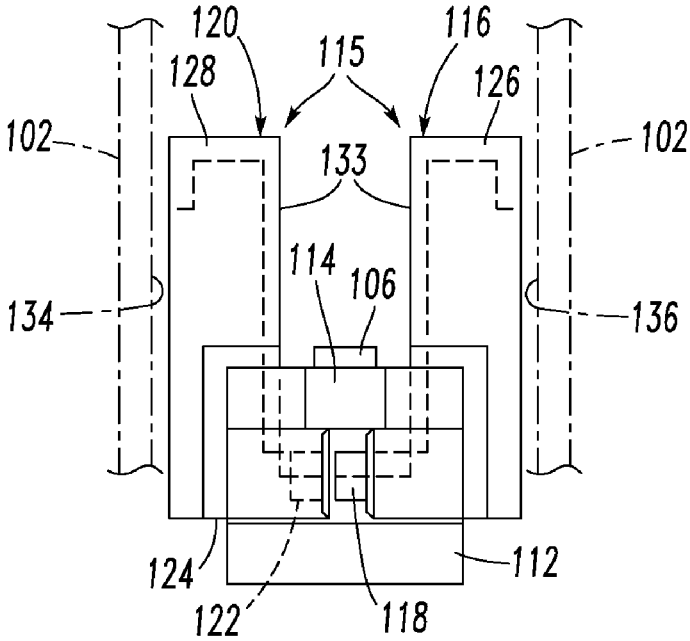

For the slot motors 115,115' of respective FIGS. 3A and 4A, the split core slot motors 115,115' have a generally U-shape. The first slot motor portions 116,116' have a generally L-shape. The second slot motor portions 120,120' have a corresponding generally L-shape. The generally L-shape and the corresponding generally L-shape cooperate to form the generally U-shape of the slot motors 115,115'.

EXAMPLE 10

The slot motor 115 of FIG. 3A achieves, for example, 480 V/200 kA high interruption current (HIC) and 480 V/10 kA per pole while maintaining the same temperature rise as a standard frame and with a withstand of approximately 13× for a 250 A frame.

EXAMPLE 11

The slot motor 115' of FIG. 4A achieves, for example, 480 V/150 kA HIC and 480 V/10 kA single pole while maintaining the same temperature rise as a standard frame and with a withstand of approximately 13× for a 250 A frame.

EXAMPLE 12

Figure 5:
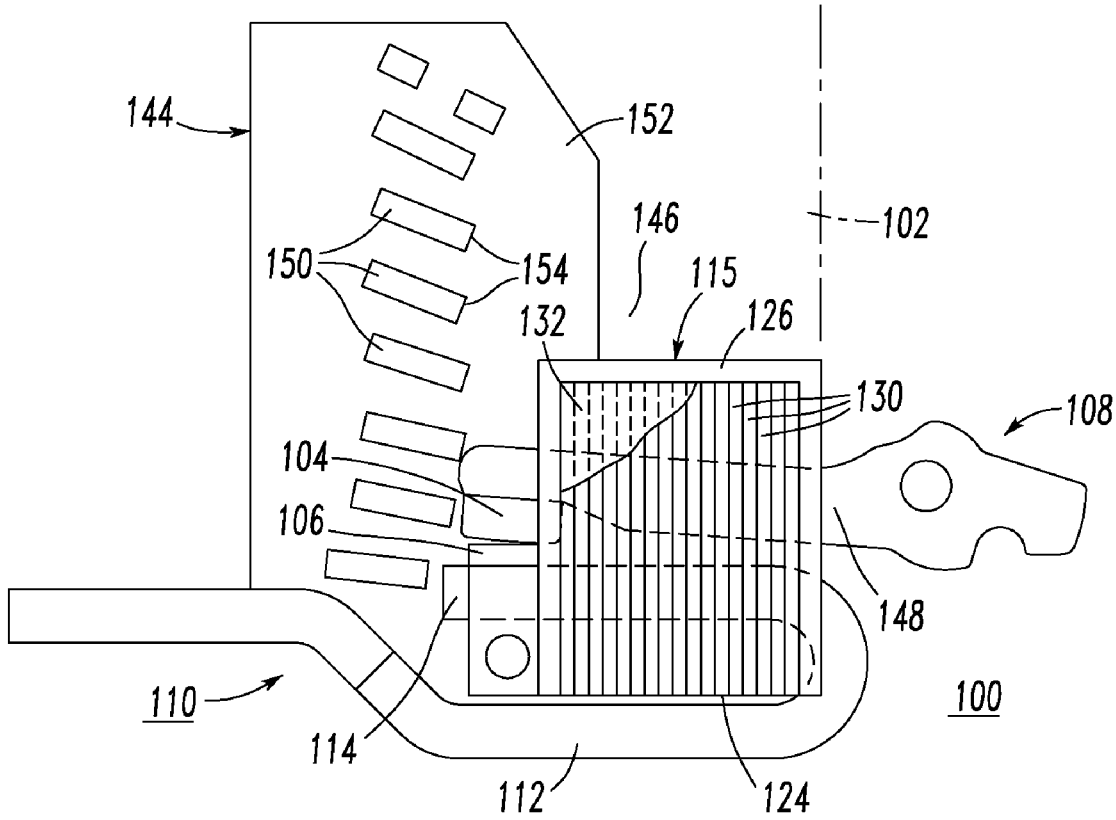
FIGS. 5 and 6 are vertical elevation views of a portion of a circuit breaker including the split core slot motor of FIGS. 3A and 4A, respectively, and an arc chute in accordance with other embodiments of the invention.
Figure 6:
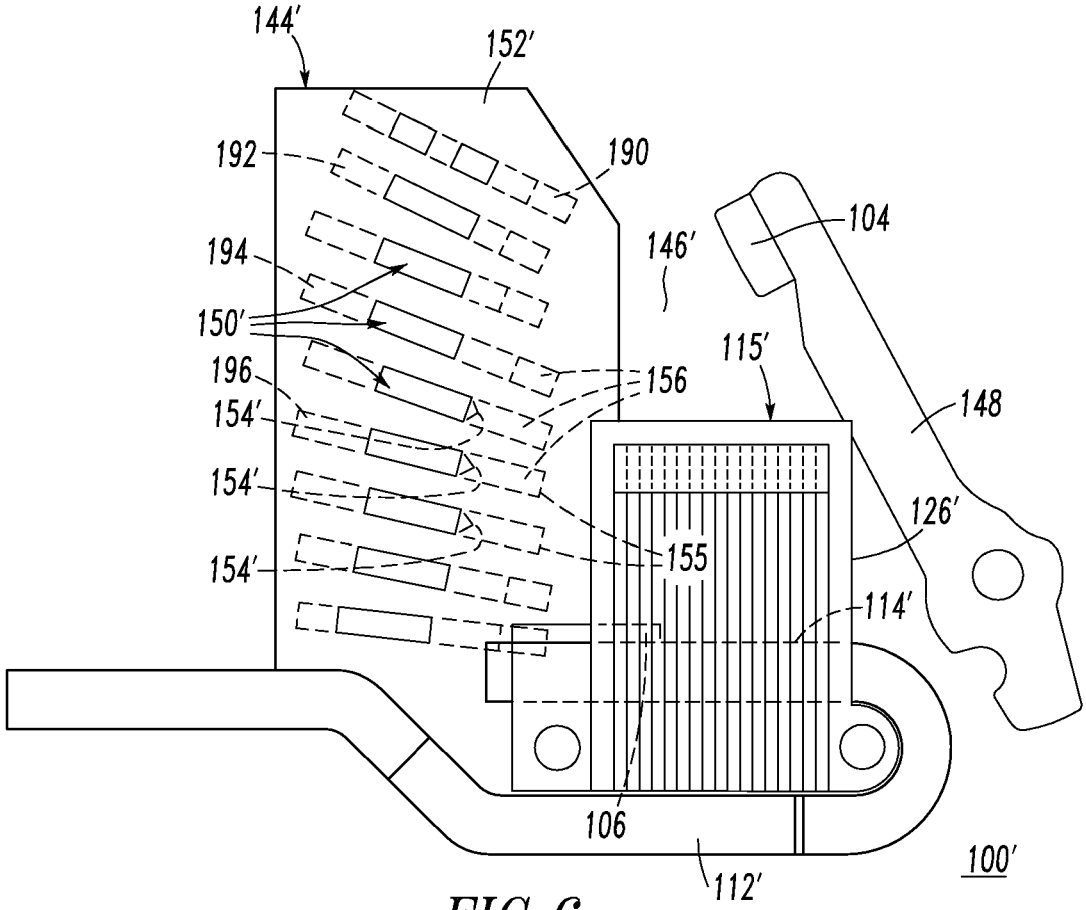

The slot motors 115,115' and the respective arc chutes 144,144' of FIGS. 5 and 6 reduce the let-through energy over known molded case circuit breakers, thereby allowing for increased short circuit interruption ratings. The slot motors 115,115' include a generally U-shaped channel that allows the slot motors 115,115' to be installed around the existing reverse loop conductors 114,114', respectively, while, also, remaining relatively closely proximate to the separable contacts 104,106 (FIG. 5). This permits effective arc cooling.

The open air space 146,146' above the respective generally U-shaped slot motors 115,115' prevents re-striking of the arc between the separable contacts 104,106. In contrast to a conventional slot motor, the much larger air space 146,146' between the movable arm 148 (as best shown with the circuit breaker 100' of FIG. 6) and the relatively low profile slot motors 115,115' prevents dielectric breakdown. The loss in magnetic field enhancement of the U-shaped, low-profile slot motors 115,115' on movable arm velocity and arc motion, as contrasted with that of conventional loop-shaped slot motors, is minimal compared to the benefit of eliminating breakdown at current-zero. In addition, the magnetic performance of the generally U-shaped, relatively low-profile slot motors 115,115' is expected to be about equal to that of a conventional slot motor during the most critical initial opening phase of the movable arm 148.

EXAMPLE 13

The insulative cover portions 126,126',128,128' of the slot motors 115,115' of FIGS. 3A and 4A are preferably made of a suitable out-gassing material. Increased arc cooling is achieved through such insulative covers being made of, for example, cellulose filled melamine formaldehyde (CMF) in close proximity to the separable contacts 104,106 (FIGS. 5 and 6). The relatively low profile, generally U-shaped slot motor configuration and the example CMF insulative cover portions 126,126',128,128' produce desirable gases during interruption in order to attain increased dielectric strength. Preferably, the CMF or other suitable out-gassing material is tightly coupled to, and preferably touches, the side walls 152,152' of the arc chutes 144,144' in order to prevent the circuit breaker base material from interacting with the plasma from the arc and, thus, improve interruption capabilities.

EXAMPLE 14

The disclosed split core slot motors 115,115' have a generally U-shape and snap together around the respective copper reverse loop conductors 114,114'. These arrangements do not require any deformation of such copper conductors 114,114' during assembly. This structure provides improvements in the short circuit interruption performance of the circuit breakers 100,100' because of the relatively narrow width channel of the slot motors 115,115' for the movable arm 148, the open ended structure of the generally U-shape, and the gassing material of the insulative cover portions 126,126',128,128'. This structure also improves economics by employing a two-piece slot motor that is assembled over the example closed-ended reverse loop conductors 114,114'. Also, the relatively low profile slot motors 115,115', as contrasted with conventional full-doughnut slot motors, reduce the probability of dielectric breakdown during interruption, especially in relatively "lower" current interruption (e.g., about 10 kA).

EXAMPLE 15

Another non-limiting example of the insulative cover material is a suitable glass filled polyester. One example is Rosite® 3550D, which is marketed by Industrial Dielectrics, Inc. of Noblesville, Ind. This material preferably provides some suitable out-gassing responsive to an arcing event.

EXAMPLE 16

Preferably, as shown in FIGS. 5 and 6, an arc chute, such as 144,144', is proximate the separable contacts 104,106. The arc chutes 144,144' include a plurality of spaced apart arc plates 150,150' disposed between insulative side members 152,152', respectively. The arc plates 150,150' include edges 154,154' facing the respective split core slot motors 115,115'. As shown in FIG. 6, the end edges 155 of a number of the arc plates 156 are separated from the insulative cover portion 126' (and the other insulative cover portion 128' of FIG. 4B) by, preferably, at least about 0.025", and more preferably about 0.1" air space. This enhances the interruption performance. Each of the insulative side members 152 and 152' engages a corresponding one of the respective insulative cover portions 126 (and the other insulative cover portion 128 of FIG. 3B) and 126' (and the other insulative cover portion 128' of FIG. 4B).

EXAMPLE 17

Referring to FIGS. 7A-7E, a generally U-shaped slot motor 160 including two legs 162,164 and a base 166, a circuit breaker power conductor 168 including a first conductor 170 and a second reverse loop conductor 172 are shown in various sequential stages of assembly. The cover 174 of the slot motor 160 preferably provides insulation as well as desirable gasses to promote good arc interruption. The relatively narrow width channel 176 of the slot motor 160 locates the gassing material in close proximity to the arc and the separable contacts (not shown) to promote efficient cooling of the arc. The U-shape or general half doughnut shape of the slot motor 160 prevents arc tracking and subsequent breakdown commonly seen in conventional full doughnut slot motors.

Figure 7F:
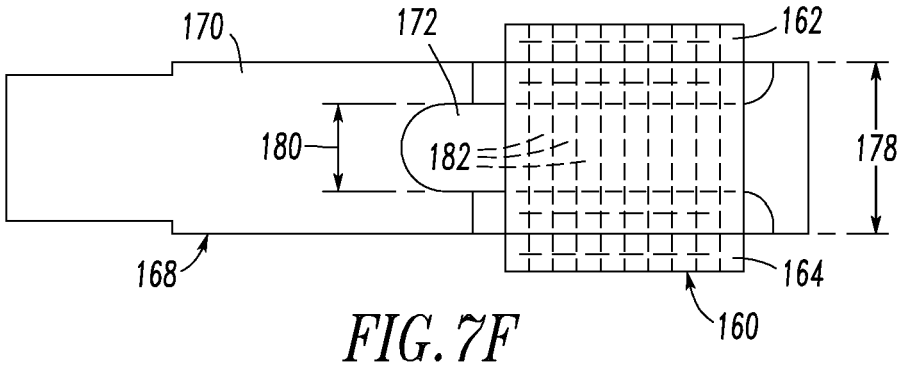
FIG. 7F is a plan view of the generally U-shaped slot motor and the circuit breaker power conductor of FIGS. 7A-7E after being assembled.
Figure 7A:
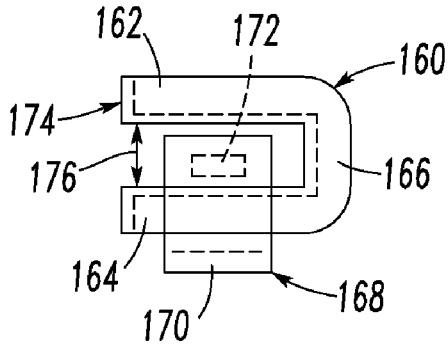
FIGS. 7A-7E are end elevation views of a generally U-shaped slot motor and a circuit breaker power conductor including a first conductor and a second reverse loop conductor in various stages of assembly in accordance with another embodiment of the invention.
Figure 7B:
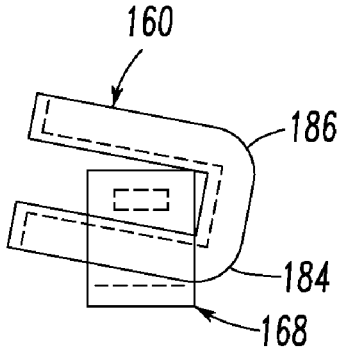
Figure 7C:
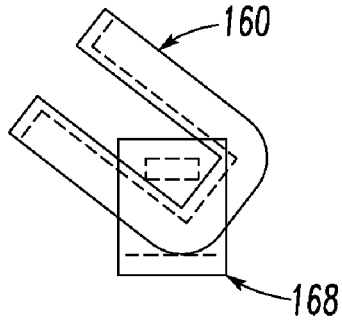
Figure 7D:
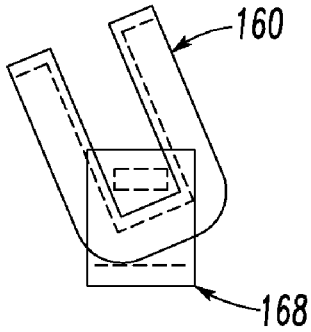
Figure 7E:
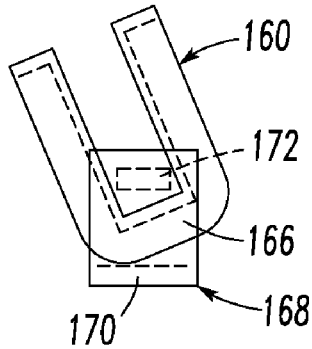

The slot motor 160 is installed in a circuit interrupter (not shown), such as the circuit breaker 100 of FIG. 5, including the power conductor 168 as follows. First, one of the legs, such as 164, of the generally U-shaped slot motor 160 is passed between the first conductor 170 and the second reverse loop conductor 172, as shown in FIG. 7A. Then, as also shown in FIG. 7A, the base 166 of the generally U-shaped slot motor 160 is positioned proximate the second reverse loop conductor 172. There, the legs 162,164 are generally planar with respect to the first conductor 170 and the second reverse loop conductor 172. Next, the generally U-shaped slot motor 160 is rotated, as shown in FIGS. 7B-7E, until the base 166 is between the first conductor 170 and the second reverse loop conductor 172. Finally, as shown in FIG. 7F, the generally U-shaped slot motor 160 is fully rotated about 90° (with respect to the initial position of FIG. 7A) until the legs 162,164 are generally normal with respect to the first conductor 170 and the second reverse loop conductor 172. Thus, FIG. 7F shows the generally U-shaped slot motor 160 and the circuit breaker power conductor 168 after being assembled. The radius outer corners 184,186 (FIG. 7B) on the edges of the slot motor 160 assist in assembly.

As shown in FIG. 7F, the first conductor 170 has a first width 178, and the second reverse loop conductor 172 has a second smaller width 180. The U-shaped slot motor 160 employs a single-piece U-shaped insulative cover 174 holding a number of slot motor elements 182.

The geometry of the U-shaped slot motor 160 allows it to be slid around the reverse loop conductor 172 rather than having to bend that conductor. This avoids adding stresses that might cause undesired contact height changes.

EXAMPLE 18

Figure 8A:
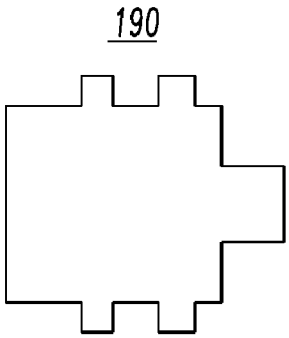
FIGS. 8A-8D are plan views of the arc plates of FIG. 6 in accordance with another embodiment of the invention.
Figure 8B:
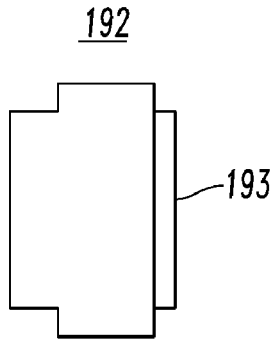
Figure 8C:
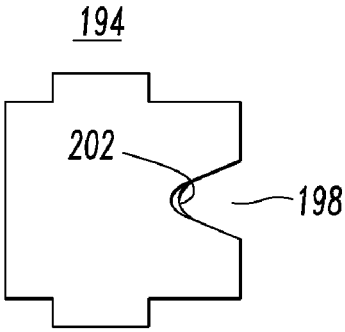
Figure 8D:
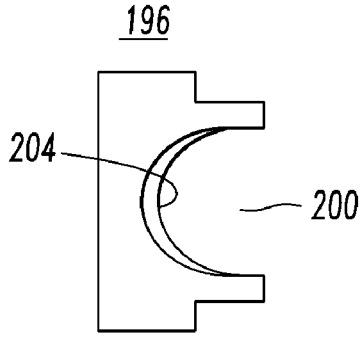
Figure 8E:
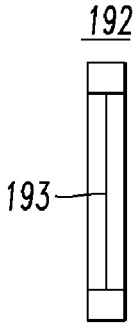
FIGS. 8E-8G are end elevation views of the arc plates of FIGS. 8B-8D, respectively.
Figure 8F:
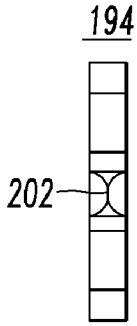
Figure 8G:
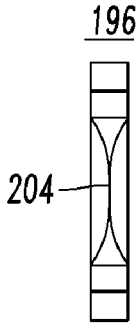

FIGS. 8A-8D show some of the arc plates 190,192,194,196 of FIG. 6. As shown in FIG. 8E, the end of the arc plate 192 further includes an edge 193. As shown in FIGS. 8F and 8G, the throat portions 198,200 of arc plates 194,196 further include edges 202,204, respectively. At least a portion of the edges 193,202,204 is tapered in order to further attract the arc into the apertures 198,200. In this manner, the tapered portions of the edges 193,202,204 function to electromagnetically attract the aforementioned arc toward the respective arc plates 192,194,196. This further serves to direct the arc within the arc plates 192,194,196, and retain it therein, as desired. It will, however, be appreciated that any known or suitable tapered edge cross-sectional profile other than the examples shown and described herein could be alternatively employed without departing from the scope of the invention. It will further be appreciated that in other embodiments of the invention, no taper of any portion of the edges of the arc plates is employed.

The disclosed slot motors 115,115',160 use the general geometry of a conventional slot motor except that the shape thereof is not a complete loop or general doughnut, is relatively low in height, and has a relatively narrow width contact channel as contrasted with conventional circuit breaker slot motors. The relatively narrow width contact channel places the magnetic material closer to the movable contact arm, such as 148, thereby increasing the movable arm opening velocity and the arc velocity. This enhances the magnetic field and promotes faster initial opening of the movable arm, thereby increasing the arc voltage at a faster rate. This also places the gassing material (e.g., CMF) insulative cover portions 126,126',128,128',174 in close proximity to the stationary contact 106 and, thus, close to the arc. This greatly increases the pressure and cools the arc and the stationary contact, especially early in the arcing sequence. All of this improves the current limiting capability of the circuit breakers 100,100' and does not permit the arc to reignite at current zero.

The relatively lower height of the slot motors 115,115', 160 and the resulting open air spaces 146,146' prevents dielectric breakdown of the contact gap, especially at current zero. In contrast, conventional doughnut slot motors can cause a re-ignition at current zero, especially in 10 kA short-circuit testing. The dielectric strength of the slot motor insulation is greatly reduced during arcing due to the high surface temperature and metal deposition on the surface of such insulation. Also, the movable arm 148 is in close proximity to the inner wall of the conventional slot motor. This relatively short air gap can easily breakdown due to the residual hot plasma and the reduced dielectric strength of the slot motor insulation.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of installing a slot motor assembly in a circuit interrupter, said method comprising:

employing a U-shaped slot motor assembly having two legs and a base;

employing a circuit breaker power conductor including a first conductor and a second reverse loop conductor;

passing one of the legs of said U-shaped slot motor assembly between the first conductor and the second reverse loop conductor;

positioning the base of said U-shaped slot motor assembly proximate the second reverse loop conductor; and rotating said U-shaped slot motor assembly until said base is between the first conductor and the second reverse loop conductor.

2. The method of claim 1 further comprising installing said U-shaped slot motor assembly in said circuit interrupter without bending said second reverse loop conductor.

3. The method of claim 1 further comprising employing as said U-shaped slot motor assembly an insulative cover holding a plurality of steel laminations.

4. The method of claim 1 further comprising disposing said one of the legs of said U-shaped slot motor assembly generally planar with respect to the first conductor and the second reverse loop conductor before rotating said U-shaped slot motor assembly about 90° until the legs of said U-shaped slot motor assembly are generally normal with respect to the first conductor and the second reverse loop conductor.

5. The method of claim 1 further comprising employing the first conductor having a first width; and employing the second reverse loop conductor having a second width which is less than said first width.

6. The method of claim 1 further comprising employing as said U-shaped slot motor assembly a single-piece U-shaped insulative cover holding a number of slot motor elements.

7. An electrical switching apparatus comprising:

a housing;

separable contacts;

an operating mechanism structured to open and close said separable contacts;

a power conductor comprising a first conductor and a second reverse loop conductor, said second reverse loop conductor carrying one of said separable contacts;

a split core slot motor comprising:

a first slot motor portion having a number of coupling points;

a second slot motor portion having a number of corresponding coupling points;

wherein the coupling points of said first slot motor portion engage the corresponding coupling points of said second slot motor portion to form said split core slot motor;

wherein both of the first and second slot motor portions cooperate to form a base of said split core slot motor;

wherein the base of said split core slot motor is disposed between said first conductor and said second reverse loop conductor; and wherein said coupling points are posts; wherein said corresponding coupling points are recesses; and wherein said posts engage said second slot motor portion at the recesses thereof to form said split core slot motor.

8. An electrical switching apparatus comprising:

a housing;

separable contacts;

an operating mechanism structured to open and close said separable contacts;

a power conductor comprising a first conductor and a second reverse loop conductor, said second reverse loop conductor carrying one of said separable contacts;

a split core slot motor comprising:

a first slot motor portion having a number of coupling points, a second slot motor portion having a number of corresponding coupling points;

wherein the coupling points of said first slot motor portion engage the corresponding coupling points of said second slot motor portion to form said split core slot motor;

wherein both of the first and second slot motor portions cooperate to form a base of said split core slot motor;

wherein the base of said split core slot motor is disposed between said first conductor and said second reverse loop conductor; and wherein said split core slot motor has a generally U-shape; wherein said first slot motor portion has a generally L-shape; wherein said second slot motor portion has a corresponding generally L-shape; and wherein said generally L-shape and said corresponding generally L-shape cooperate to form said generally U-shape.

* * * * *